US006231464B1

(12) United States Patent
Curtis

(10) Patent No.: US 6,231,464 B1
(45) **Date of Patent: *May 15, 2001**

(54) TRAINING DEVICE FOR A BASEBALL BATTER

(76) Inventor: Kevin D. Curtis, 1672 Redding Way, Upland, CA (US) 91784-1930

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,906

(22) Filed: Jun. 3, 1998

(51) Int. Cl.[7] ..... A63B 69/00
(52) U.S. Cl. ..... 473/458; 473/422
(58) Field of Search ..... 473/458, 422, 473/450, 451; 2/19, 161.1, 170, 166, 161.4, 159, 162, 161.5, 161.2, 311, 312, 338; 224/219

(56) References Cited

U.S. PATENT DOCUMENTS

| | | | | |
|---|---|---|---|---|
| D. 331,937 | * | 12/1992 | Moon | D16/237 |
| 1,404,719 | * | 1/1922 | Postl . | |
| 1,584,476 | * | 5/1926 | Schalow . | |
| 2,436,755 | * | 2/1948 | Lapell | 2/159 |
| 2,650,590 | * | 9/1953 | Moore et al. . | |
| 2,852,779 | * | 9/1958 | Roessler | 2/161.2 |
| 3,707,730 | * | 1/1973 | Slider | 2/161.1 |
| 3,725,957 | * | 4/1973 | Shotmeyer | 2/161.1 |
| 3,888,244 | * | 6/1975 | Lebold | 602/48 |
| 4,388,733 | * | 6/1983 | Anstett | 2/16 |
| 4,564,956 | * | 1/1986 | DiBuono | 2/16 |
| 4,665,565 | * | 5/1987 | Odom | 2/161.2 |
| 4,700,405 | * | 10/1987 | Sternberg | 2/161.1 |
| 4,991,234 | * | 2/1991 | Greenberg . | |
| 5,004,231 | * | 4/1991 | Alread | 482/139 |
| 5,033,119 | * | 7/1991 | Wiggins | 2/162 |
| 5,130,899 | * | 7/1992 | Larkin et al. | 362/570 |
| 5,517,694 | * | 5/1996 | Fabry | 2/161.1 |
| 5,538,500 | * | 7/1996 | Peterson | 602/4 |
| 5,553,324 | * | 9/1996 | Emerson | 2/158 |
| 5,557,806 | * | 9/1996 | Caswell et al. | 2/161.1 |
| 5,685,787 | * | 11/1997 | Kogut | 473/409 |
| 5,839,978 | * | 11/1998 | Evangelist | 473/458 |
| 5,890,228 | * | 4/1999 | Wagner | 2/160 |
| 5,898,938 | * | 5/1999 | Baylor | 2/20 |
| 5,898,944 | * | 5/1999 | Vrany | 2/161.4 |

OTHER PUBLICATIONS

*It's Angel Time*, Official Golf Newsletter of the ProWedge Angel Training System, vol. I, Issue 1, Oct.–Dec., 1997, published by ProWedge, Inc., Salt Lake City, Utah.

Product Promotional Brochure, "Welcome to the ProWedge Family of High Quality Golf Products," undated, for the ProWedge Angel, distributed by ProWedge Incorporated, Salt Lake City, Utah.

Instructions on Fastening the Cuffs, Adjusting the Angel, and Removing the Angel Wings, as contained in ProWedge Angel promotional brochure, p. 12A.

Advertisement for Rotary Grip, p. 9, *Baseball America* magazine, Issue on sale Apr. 13, 1998.

* cited by examiner

*Primary Examiner*—Jeanette Chapman
*Assistant Examiner*—M. Chambers
(74) *Attorney, Agent, or Firm*—Lyon & Lyon LLP

(57) ABSTRACT

Described herein is a training device and methods of use thereof for helping a baseball batter keep both hands on the bat while swinging at a ball, thus training the batter to swing with more power, better bat control, and better discipline in taking (i.e. not swinging at) bad pitches. The device includes a right wristband and a left wristband connected by a knuckle cover which covers a portion of the batter's knuckles. The device may also include a finger strap to further ensure that the device does not rotate around the wrist or hands and become improperly positioned across the knuckles.

20 Claims, 3 Drawing Sheets

TRAINING DEVICE FOR A BASEBALL BATTER

FIELD OF THE INVENTION

The present invention relates generally to the sport of baseball, and more particularly to devices and methods of use thereof to help a batter improve his or her batting performance.

BACKGROUND OF THE INVENTION

The game of baseball has been loved and enthusiastically supported for over 150 years. It remains one of America's favorite sports. Baseball fields in need of up-dating are being modernized and new state-of-the-art facilities are being built, nationwide, for both Major and Minor league teams. Baseball has become increasingly popular abroad and now offers viewer entertainment for millions of fans via television or live games in a growing number of international baseball parks.

Fans and players alike are captivated by unusual and often spectacular plays. Especially exciting are home runs, or clutch hits in key situations. Even hard hit balls not scored as hits can advance play of the game and provide added excitement. Every hit in baseball is an accomplishment for the batter, because in a confrontation between a good pitcher and a good batter, the pitcher is considered to have a definite advantage. That is why most hitters get base hits less than 30% of the time (a 0.300 season batting average). The best hitters generally achieve between a 0.300 and 0.350 season average. In fact, only a few great hitters in the history of professional baseball have ever managed to complete a season with a batting average of close to 0.400 or above.

Over the years, various batting methods and styles have been promoted by college and professional coaches and used by their players (and many others). To determine a desired batting style many factors are considered but there is one fundamental concept that is relentlessly emphasized by almost every experienced batting coach from Little League to the upper echelons of professional baseball. It is to swing the bat with two hands.

At first this may seem like an elementary concept but it is an increasing problem for hitters at every level. Today, more and more batters are showing a tendency to prematurely release their top hand from the bat during their swing. This is considered a bad habit by most batting coaches. The device described herein will help teach hitters how to involve both hands throughout the entire swing, thus increasing the chances of a hard hit ball, and improving other areas of their batting performance as described herein.

Watching historical films of older baseball games, one can see that the best hitters swung with both of their hands remaining on the bat all the way through the forward motion of their swing, even after making contact with the pitched ball. This generates more power upon impact with the ball, improves bat control, and improves discipline in selecting pitches at which to swing. In fact, many of the most prestigious hitting records in baseball are still held by "old timers" such as Ty Cobb and Mickey Mantle who used the two-handed swing. That swing was most likely a contributing factor in their success.

Since the Ty Cobb and Mickey Mantle era, hitters have been subjected to many new hitting techniques, such as the Walt Reniak theory of hitting. This theory actually promotes the release of the top hand from the bat during the swing. As the top hand is the control or guidance hand, these techniques suggest that control or guidance are needed only during the first part of the swing. Such advice makes it appear as if the top hand doesn't play as important a role as it does. This sends a very confusing message to young or inexperienced hitters who may try to emulate the Fred McGriff style of follow-through. This style is very unorthodox and uncommon, and would be very hard to successfully duplicate. I want to eliminate top hand release before and during impact so a hitter can maximize the use of both hands.

The premature release of the bat by the top hand limits the batter's control over where the ball is hit into the field. This usually results in a ball hit in an unintended direction and without much power, such as a weak grounder or a pop-up fly ball. The premature release of the bat by the top hand also gives the batter the ability to reach further out across the plate and swing at bad pitches (e.g., outside pitches that would otherwise be called "balls" by the umpire). By continuing to do this, the batter conditions himself or herself to erroneously perceive a strike zone beyond the actual area of home plate.

It would thus be desirable to have a device for training a baseball player to keep both hands together while swinging the bat, thus conditioning the player to swing with more power, better bat control, and better discipline in taking (i.e. not swinging at) bad pitches. The inventor of the methods and devices described herein was a professional baseball player who had the opportunity to play under the tutelage of some of the most experienced college and professional coaches in the country, coast to coast. He knows of no such device currently available.

SUMMARY OF THE INVENTION

It is an object of the present invention to provide an improved method and device for training an athlete to keep both hands on a piece of sporting equipment while swinging or otherwise maneuvering the piece of equipment.

It is another object to provide improved methods and devices for training a baseball player to keep both hands on the bat while swinging the bat at a ball.

It is another object to provide improved methods and devices for training a baseball player to hit the ball with more power.

It is another object to provide improved methods and devices for training a baseball player to exhibit improved bat control.

It is another object to provide improved methods and devices for training a baseball player to be more disciplined in taking (i.e. not swinging at) pitches that are likely to be called "balls" by the umpire.

In various embodiments of the present invention, the above objects are accomplished by a durable, lightweight training device comprising a first wristband to be wrapped around the player's right wrist, a second wristband to be wrapped around the player's left wrist, and a knuckle cover connecting the two wristbands. Optionally, there may be at least one finger strap located on the knuckle cover. The training device is designed to hold the player's hands, to a limited degree, such that the player's hands cannot separate a significant amount while swinging the bat. The training device is designed also to be flexible enough so as not to otherwise interfere with the player's normal swing of the bat.

The wristbands may be open-ended, requiring them to be wrapped around the player's wrists, or closed, in which case they may be slipped over the player's wrists. They may be adjustable and/or elastic. The finger-strap(s) may also be open-ended or closed, and adjustable and/or elastic. A single training device may be reoriented to be used by a right-handed batter in one orientation, and a left-handed batter in another orientation, thus allowing a switch-hitter to practice from both sides of the plate using the same device.

Though the present invention is described throughout this application for use by a baseball player, the invention may also be useful for other athletes in analogous sports such as slow-pitch softball, fast-pitch softball, cricket, tee-ball, etc. Thus, when the terms "baseball player," "hitter," or "batter" are used, it is to be understood that unless the context of use is unquestionably limited, the term includes slow-pitch softball players, fast-pitch softball players, tee-ball players, etc. of all ages and skill levels.

DETAILED DESCRIPTION

Figure 1:
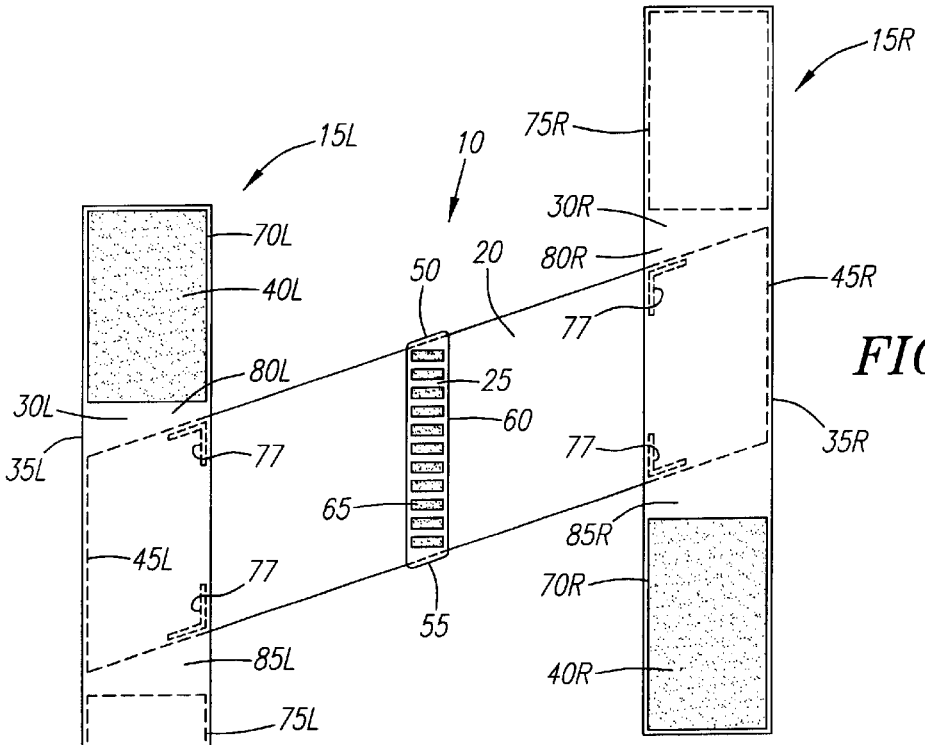
FIG. 1 shows a training device in accordance with the present invention, having open-ended wristbands and oriented for use by a right-handed batter.

Reference numerals as used herein will end with a capital "L" or capital "R" when used to specifically refer to a component involving the "L"eft or "R"ight side respectively of the training devices described herein.

The training device of the present invention is designed to train hitters to keep both hands together, and consequently on the bat, during the entire swing. By practicing with this device, hitters will improve three major areas of their swing. The results will be more power, better bat control, and better discipline in pitch selection. All of these factors should lead to a greatly improved overall batting performance for hitters.

As for increased power, it is simple physics. Hitters can generate more force by swinging the bat with two hands rather than with one hand. Increased force generally translates into a harder hit ball which travels faster and farther.

Keeping both hands on the bat also improves bat control. Since the top hand is the "control" or "guidance" hand, a hitter must keep the top hand on the bat to retain maximum control of the bat. Good bat control should help a batter "stay on top" of the ball instead of "getting under" it, and should thus lead to more consistent solid contact and less weak grounders and pop flies. Bat control is especially important when a hitter is trying to place the ball in play in a general or even a particular spot. For example, during a hit-and-run or a steal, the batter may try to hit the ball towards a spot in the infield likely to be left abandoned by an infielder covering a base. In another situation, with a runner on second base and less than two outs, the batter may try to hit the ball to the right side (between first and second base) to advance the runner to third. When the infielders are positioned for an expected bunt, the hitter may aim to hit a sharp grounder at the first or third baseman, or to hit a grounder through an open hole in the infield caused by the defense's positioning. Other situations may also exist where there is an open gap in the field due simply to the positioning of the fielders. Bat control is also important for "going with the pitch," e.g., pulling an inside pitch or hitting an outside pitch to the opposite field.

Pitch selection discipline is also improved by keeping both hands on the bat throughout the swing. Hitters first determine approximately where to stand in the batter's box such that their balanced, two-handed swing covers the entire plate (i.e. the width of the strike zone). Then, if the hitters catch themselves lunging, reaching, or otherwise swinging off-balance at a pitch, they will be confident that the pitch is likely to be called a "ball" by the umpire. As the hitters practice more and more with the training methods and devices described herein, they will become accustomed to what a balanced, two-handed swing feels like, and will naturally lay off of (i.e. not swing at) pitches that would require them to deviate from their established form.

The training device described herein helps eliminate the bad habit of premature top hand release, because the device creates "positive muscle memory" and "motor memory" for hitters who consistently practice with the device. In other words, by practicing with the device, hitters condition themselves to naturally keep both hands on the bat during the swing. Then, when a hitter swings without using the device, such as in real competition, the hitter will keep both hands on the bat out of habit or conditioning.

Turning now to the drawings, and in particular FIG. 1, there is shown a training device 10 in accordance with the present invention, oriented for use by a right-handed batter. Open ended wristbands 15L, 15R are connected by a knuckle cover 20, and a single finger strap 25 is secured to knuckle cover 20.

Wristbands 15L, 15R are made preferably from a durable elastic material. Each wristband 15L, 15R may be just a single layer of material, but it is preferred that they each comprise two layers sewn, glued, or otherwise connected together at various points, as discussed herein. In either case, each wristband 15L, 15R has an inner surface 30L, 30R respectively which contacts the batter's left or right wrist respectively, and an outer surface 35L, 35R respectively. Primary fastener materials 40L and 40R are attached at appropriate locations on inner surfaces 30L and 30R of wristbands 15L and 15R respectively, while companion fastener materials (not shown) are attached at appropriate locations on outer surfaces 35L and 35R of wristbands 15L and 15R respectively. Materials 40L, 40R may be, for example, the looped side of a Velcro-type fastener, in which case the companion materials would comprise the hooked side.

Primary fastener materials 40L, 40R, and companions are attached to wristbands 15L, 15R preferably by stitching, but may be attached by gluing, snapping, zipping, or any other fashion, and are used to secure adjustable wristbands 15L, 15R around the batter's wrists. The use of a Velcro-type fastener (hooked and looped sides) is preferred, in which case wristbands 15L, 15R may be tightened by wrapping them to a desired position, ensuring that a sufficient portion of material 40L or 40R remains joined with its companion material. Wristbands 15L, 15R may be adjustable in other ways as well. Examples include: large snaps; hooks such as those commonly used on braziers; buttons in combination with button holes; a buckle mechanism similar to a dress belt; a protrusion/hole combination similar to many adjustable baseball hats; a ratcheted mechanism similar to large trash bag ties; a drawstring; plastic seat-belt buckles as are commonly used in baby car seats, or any combination of the aforementioned.

Device 10 may be cut from a pattern in which wristbands 15L, 15R and knuckle cover 20 are already pre-formed as part of the same single piece of fabric, but knuckle cover 20 is preferably a separate piece of material connected to wristbands 15L, 15R by stitching, buttons, adhesive, hot or cold bonding, snaps, or other means. In the latter case, knuckle cover 20 is preferably made of the same type of material as wristbands 15L, 15R (although preferably it is wider and stronger), and is connected to wristbands 15L, 15R by stitching 45L, 45R.

Finger strap 25 is also preferably made of the same, or similar material as wristbands 15L, 15R and knuckle cover 20, and is preferably a non-roll weave. It is attached to knuckle cover 20 in a reinforced "over-stitch" manner preferably substantially parallel to the longitudinal axes of wristbands 15L, 15R, and equidistant from each wristband 15L, 15R along the longitudinal axis of knuckle cover 20. Finger strap 25 is preferably connected to knuckle cover 20 at opposite edges of knuckle cover 20 at, for example, areas 50 and 55. It may also be connected near the center 60 of knuckle cover 20, thus effectively forming two separate finger straps (not shown). Similarly, there may be two physically separate finger straps (not shown), one being connected to area 50 and center 60, while the other is connected to area 55 and center 60. Finger strap 25 may also have reinforcing ridges 65 sewn or formed into its surface for helping to prevent it from becoming twisted or frayed. Finger strap 25 is preferably fixed, but may be adjustable by a drawstring (not shown) or other mechanism. Finger strap 25 helps keep device 10 from rotating freely around the batter's wrists as a result of numerous violent swings.

Where two layers of material are used for a wristband (15L for example) the layers may be formed by two separate pieces of material, or by one piece of material folded around and back under itself. If two pieces of material are used, the layers are combined by placing them co-linearly on top of one another, and then stitching or otherwise securing them together at both ends. In the embodiment where one piece is folded back upon itself, the folded end is stitched to flatten and the other end is stitched to secure the two tabbed ends. In a third embodiment, using a single piece, the layers are combined by wrapping the piece around to form a continuous circular strip, then stitching the open ends of the strip together to form a closed loop. In the first two embodiments, a two layer strip is formed where the top of one layer is inner surface 30L of wristband 15L, and the bottom of the other layer is bottom surface 35L of wristband 15L. The two layers are then stitched together as indicated by stitches 45L, 70L, and 75L. Stitches 45L also secure knuckle cover 20 between the layers, while stitches 70L secure primary fastener material 40L to wristband 15L, and stitches 75L secure the companion fastener material (not shown) to wristband 15L. Stitches 45R, 70R, and 75R perform similar purposes for right wristband 15R. The stitching is preferably reinforced in high stress areas as indicated by reinforcing stitches 77. At sections 80L, 80R, 85L, and 85R, the two layers remain open and separate from each other (i.e. not stitched) so that when wristbands 15L, 15R are stretched or adjusted, there is room for play and the resulting stress on stitches 45L, 45R, 70L, 70R, 75L, and 75R is minimized.

It should be noted that although each wristband 15L, 15R just described may be considered closed (i.e. forming substantially a circular strip) prior to completion of the stitching, the ultimate configuration of wristbands 15L, 15R in the embodiment just described results in open-ended wristbands 15L, 15R when unfastened. This is to be distinguished from an alternate embodiment of device 10, wherein the intended configuration results in closed wristbands 15L, 15R as seen in FIG. 3 and as will be described shortly.

Figure 2:
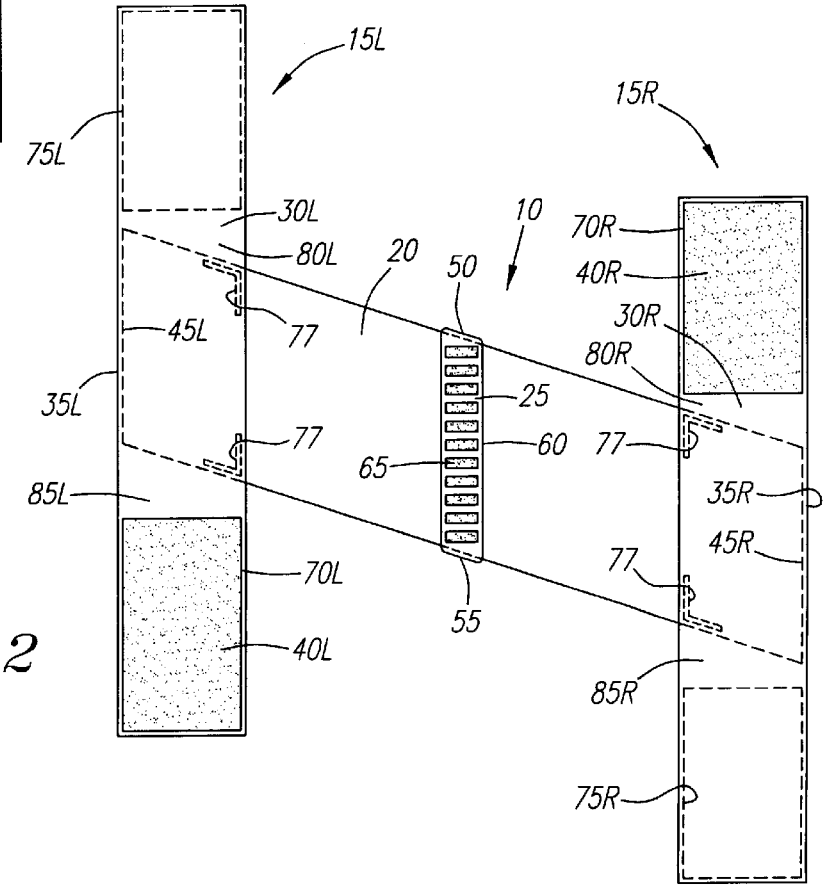
FIG. 2 shows a training device in accordance with the present invention, having open-ended wristbands and oriented for use by a left-handed batter.

Turning now to FIG. 2, there is shown a training device 10 in accordance with the present invention, oriented for use by a left-handed batter. The left-handed device 10 differs from the right-handed device 10 shown in FIG. 1 as follows. When laid out in preparation for use, knuckle cover 20 on the left-handed device 10 lies substantially diagonally downward from left to right, as seen in FIG. 2. By comparison, knuckle cover 20 on the right-handed device 10 lies substantially diagonally upward from left to right, as seen in FIG. 1. The result is that on the left-handed device 10 as seen in FIG. 2, the top of left wristband 15L rests higher than the top of right wristband 15R when device 10 is laid flat with finger strap 25 facing up, while on the right-handed device 10 as seen in FIG. 1, the top of right wristband 15R rests higher than the top of left wristband 15L when device 10 is laid flat with finger strap 25 facing up. The reason for two designs is to accommodate the fact that left-handed batters grip the bat with their left hand above their right, while right-handed batters grip the bat with their right hand above their left. Though a right-handed device 10 and a left-handed device 10 may in fact be two physically different objects, a single device 10 may be interchangeable and used as both a right-handed device 10 and a left-handed device 10, simply by reorienting the finger strap. For example, using a right-handed device 10 with a single finger strap 25, one of wristbands 15L or 15R may be pulled completely through finger strap 25. This reorients the right-handed device 10 into a left-handed device 10, which is an added convenience for a switch-hitter. The only slight disadvantage of doing this, as opposed to using two separate physical devices, is that finger strap 25 would no longer visually appear to have been attached (stitched) in a preferred manner and may experience more stress at areas 50 and 55 where it is connected to knuckle cover 20, although it is not likely.

Figure 3:
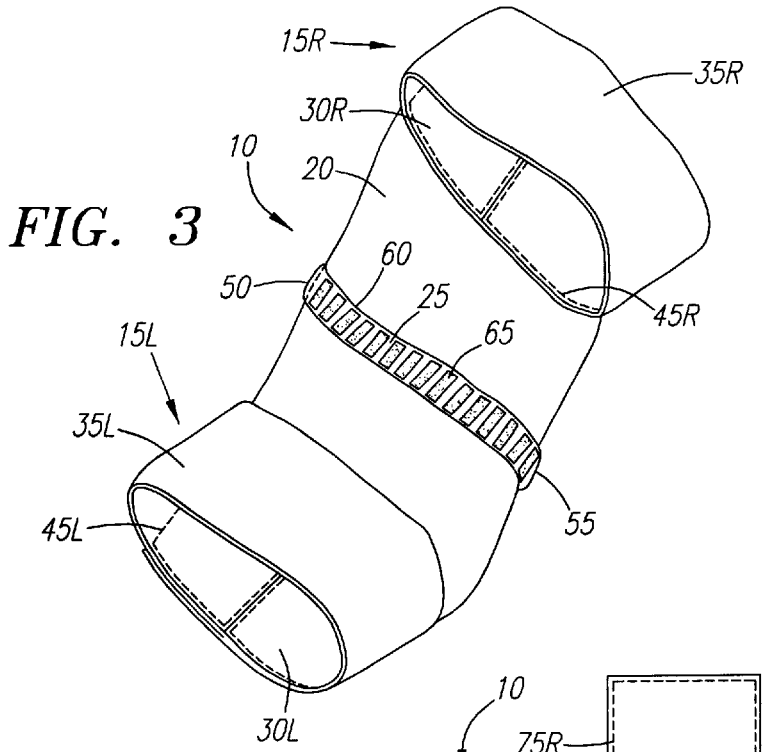
FIG. 3 shows an alternate embodiment of the training device in accordance with the present invention, having closed elastic wristbands and oriented for use by a right-handed batter.

Wristbands 15L, 15R have been described as open-ended in connection with FIG. 1 and FIG. 2, but as previously stated, wristbands 15L, 15R may be closed such that they each form substantially a circular loop, as seen in FIG. 3. Closed wristbands 15L and 15R may seem to be easier for some players, especially young players, to get on and off than the open-ended ones. Adjustable wristbands with some type of fastener eliminate a too loose or too tight fit for the wearer. Closed wristbands may be easier for some to put on, but eliminate the option for each individual hitter to either tighten or loosen the wristband according to his or her preference. Closed wristbands 15L and 15R may also offer a less expensive manufacturing alternative, considering the cost of primary fastener materials 40L, 40R and their companions could be eliminated. Closed wristbands 15L, 15R may be elastic material fixed to knuckle cover 20, or they may be adjustable by drawstrings (not shown), or other mechanisms described herein in relation to open-ended wristbands 15L, 15R.

Figure 4:
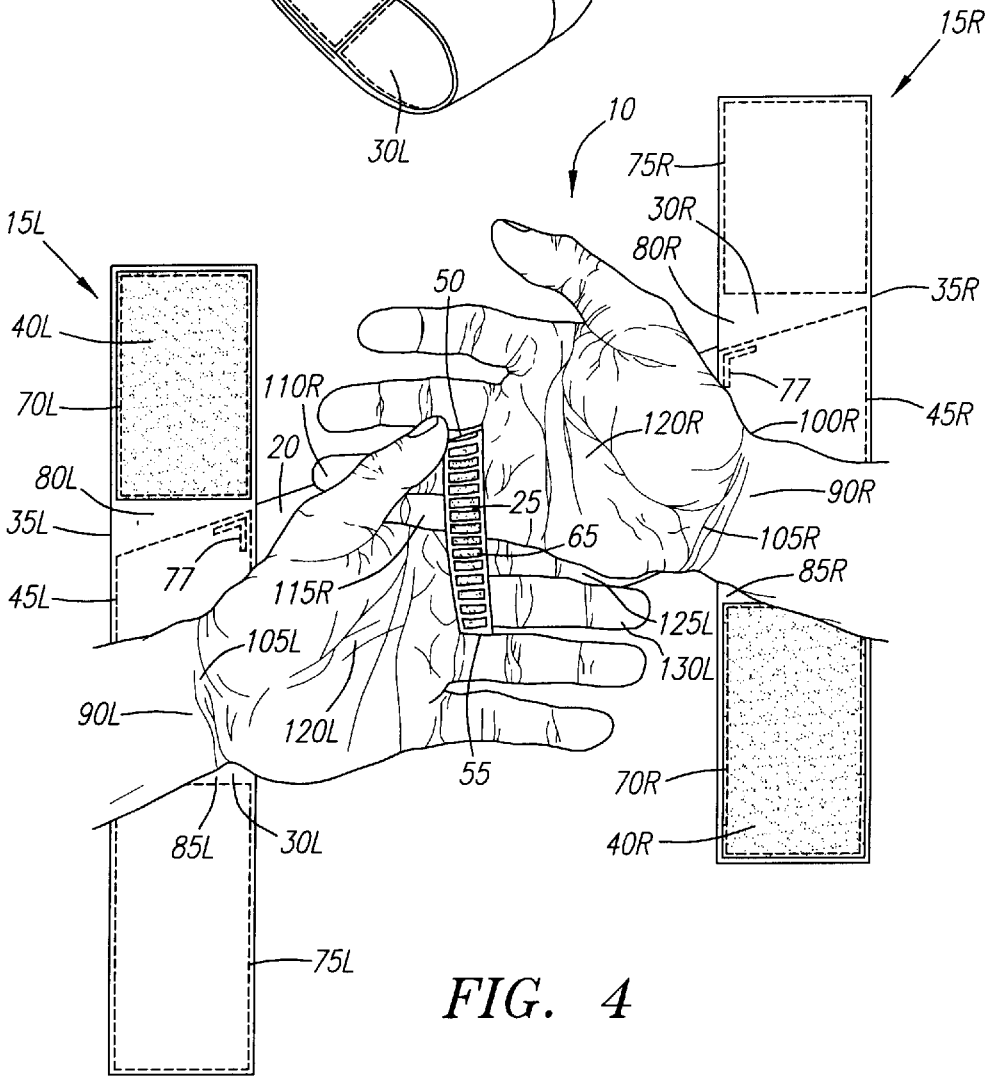
FIG. 4 shows the fingers of a right-handed batter inserted into the single finger strap of the training device in FIG. 1, in preparation for securing the wristbands to the batter's wrists.
Figure 5:
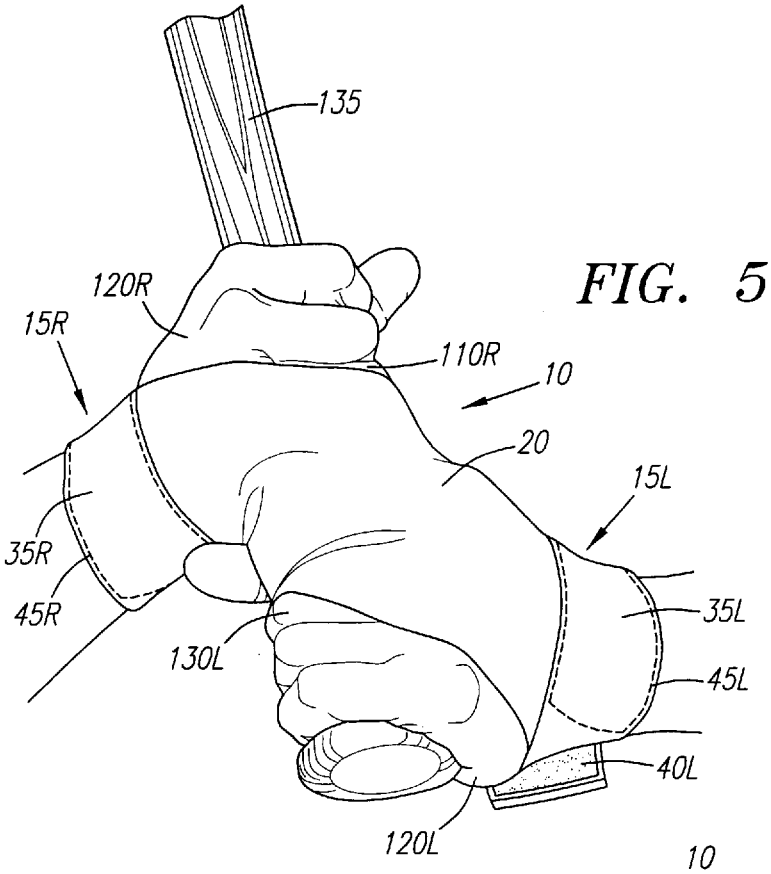
FIG. 5 shows the training device in FIG. 4, after the wristbands have been wrapped around and secured to the batter's wrists, with the batter holding a bat.

To illustrate actual use of device 10, we turn now to FIG. 4 and FIG. 5, which show a device 10 for a right-handed batter. FIG. 4 shows the fingers of a right-handed batter inserted into the single finger strap 25 of the training device 10 as seen in FIG. 1, in preparation for securing wristbands 15L, 15R to the batter's wrists 90L, 90R.

After device 10 is laid out, preferably on a flat surface, the outside 100R of the batter's right wrist 90R is placed on top of and near the center of wristband 15R, with the inside 105R of wrist 90R facing up. The ring finger 110R and pinkie 115R of the batter's right hand 120R are then slid through finger strap 25, and wristband 15R is secured (and adjusted if applicable) over the batter's right wrist 90R.

The outside 100L of the batter's left wrist 90L is then placed on top of and near the center of the left wristband 15L, with the inside 105L of the batter's left wrist 90L facing up. The batter's index finger 125L and middle finger 130L are slid through finger strap 25, below right fingers, 110R, 115R. Wristband 15L is then secured (and adjusted if applicable) over the batter's left wrist 90L. Once device 10 is secured, the batter may adjust how device 10 lays across hands 120L, 120R and over the knuckles by simply rotating the secured wristbands 15L, 15R for maximum comfort. The batter is then ready to begin training, as seen in FIG. 5 where knuckle cover 20 covers a portion of the right-handed batter's knuckles, and the batter is gripping the handle of a bat 135 in a ready-to-swing manner.

Of course, the order in which the above steps are performed may vary, so long as the end result is that device 10 is secured substantially as seen in FIG. 5. For a left-handed batter, the process is similar and can be accomplished as described above by simply replacing "fright" with "left" and "left" with "right" in the preceding explanation of how to apply the right-handed device 10.

Figure 6:
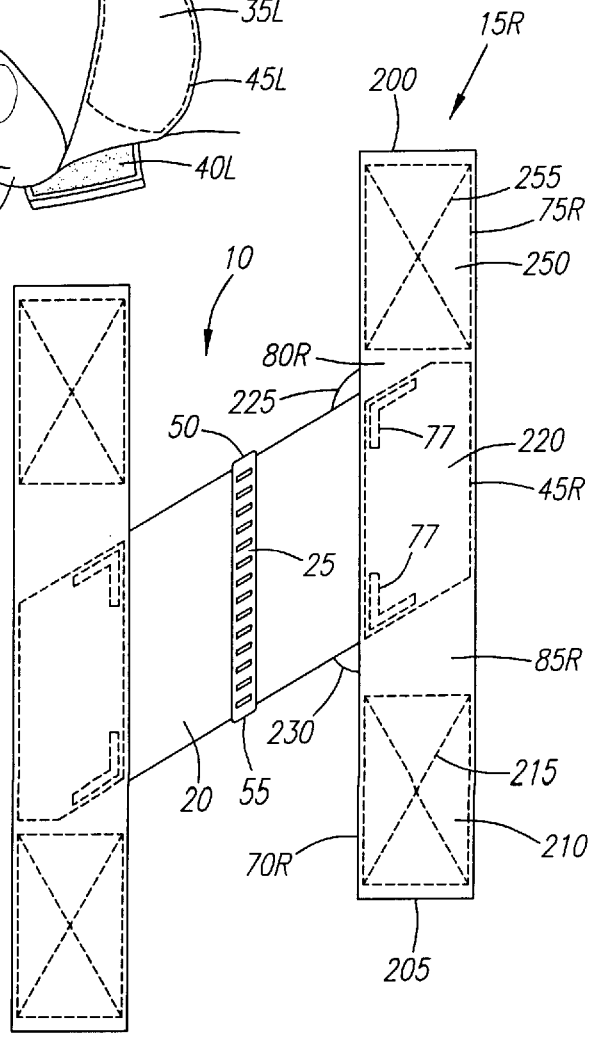
FIG. 6 shows location points on the device for assembly purposes.

Referring now to FIG. 6, a preferred embodiment of an eleven inch (11") long right-handed device 10 as described herein may be constructed in the following manner. In the following description, when sewing is described near an edge of the fabric, it is recommended that the sewing be done as close to the edge as possible while still maintaining a closure that will not pull out.

First, the required materials must be obtained. These include: two twenty-six inch by two inch (26"×2") strips of black elastic for wristbands 15L, 15R (style #SS6156 BLK); one eleven inch by four inch (11"×4") strip of black elastic for knuckle cover 20 (style #17067W BLK); and one five and a quarter inch by three quarter inch (5¼"×¾") strip of black elastic for the finger strap 25 (style #SS1102 BLK). All of the above-referenced materials are available through the South Carolina Elastic Company, Pawtucket, R.I. Other materials needed are two three inch by two inch (3"×2") strips of black Velcro-type grid (hook) for primary fastener materials 40L, 40R; and two three inch by two inch (3"×2") strips of black Velcro-type loop for the companion fastener materials. These are available as a set (style #400 BLK) through Aplix, Inc., Moorpark, Calif. Finally, black thread is needed, such as that made by Coats and Clark and designated as "#ART .D64 S A2, 0-73650-86609-8, T-26 137-M."

To begin, on each end of one of the twenty-six inch (26") long pieces of elastic, a ¾ inch tab is folded inwardly (i.e. each tab is folded toward the other), and sewn down, such that the elastic is then approximately twenty four and one half inches (24½") long. This piece of elastic will be right wristband 15R. Wristband 15R is then folded in half at 200 with the cut side of the tabbed ends together and facing inwardly toward each other at 205. The two previously sewn tabbed ends are then sewn together at 205 as close to the folded side of the tabbed ends as possible. One of the 3"×2" pieces of looped material is then pinned into position at 210, approximately ¼" from the double-tabbed ends, and then sewn on through the two layers of elastic. The looped material should be sewn on around the edges to form a rectangle as seen by stitches 70R, and also in an "X" pattern as seen by stitches 215 within the rectangle, taking care to keep all sides as even as possible. At sections 80R and 85R, the two layers of elastic forming right wristband 15R remain open and separate from each other (i.e. not stitched) so that when wristband 15R is stretched or adjusted, there is room for play and the resulting stress on stitches 45R, 70R, and 75R is minimized.

Next, the eleven inch by four inch (11"×4") strip of black elastic for knuckle cover 20 is pre-cut based on a pattern or template in which the piece would form angles of intersection with right wristband 15R of approximately 100 degrees to 135 degrees at 225 (more preferably 110 degrees to 125 degrees) and approximately 45 degrees to 80 degrees at 230 (more preferably 55 degrees to 70 degrees). The piece would extend out (not shown) past the edge of wristband 15R, and the portions that are cut are those that would extend out past wristband 15R, when laid on the pattern. It is desirable to use a pattern or template for laying the materials on to ensure accurate measurements. The pre-cut piece is then inserted between the two sections of elastic (like a sandwich) at 220. Knuckle cover 20 is then pinned and subsequently sewn between the two sections of elastic as seen by stitches 45R. Reinforcing stitches 77 are then sewn in at high stress points. Preferably, two sets of five or six reinforcing stitches each are sewn in at each angle opposite angles 225 and 230.

The material is then flipped over so that the looped material previously sewn on is facing down. The folded end 200 is then smoothed toward the fold, and one of the three inch by two inch (3 "×2") strips of hooked fastener material is pinned in place at 250, approximately ¼" from the folded ends. Note that the hooked material at 250 is on outer surface 35R of right wristband 15R, while looped material at 210 is on inner surface 30R of right wristband 15R. The hooked material is then sewn in place by a rectangular pattern through the two layers of elastic, as indicated by stitching 75R, ensuring that all sides are as even as possible. An "X" 255 is then sewn within rectangle formed by stitching 75R.

Similar steps are performed on the other side of the device to secure the knuckle cover 20 to the second twenty-six inch (26") piece of elastic (left wristband 15L), after which the device will be completed except for attachment of finger strap 25. To attach finger strap 25, the five and a quarter inch by three quarter inch (5¼"×¾") strip of elastic is pinned to knuckle cover 20 preferably substantially parallel to the longitudinal axes of wristbands 15L, 15R, and equidistant from each wristband 15L, 15R along the longitudinal axis of knuckle cover 20. Finger strap 25 is then sewn to knuckle cover 20 along edges at areas 50 and 55, and any excess pieces of elastic from finger strap 25 that extend beyond the edges of knuckle cover 20 are trimmed.

While certain embodiments are illustrated in the drawings and are described herein, it will be apparent to those skilled in the art that many modifications can be made to the embodiments without departing from the inventive concepts described. For example, the training device may be made from preformed rubber, neoprene, foam or other materials, and the size, dimensions, weight, elasticity, durability, and other aspects of the training device described herein may vary according to an athlete's needs or preferences. Another example is that the wristbands and knuckle cover may be implemented as right-handed and left-handed batting gloves connected at appropriate locations (e.g., along a seam where the index finger one glove cooperates with the pinkie of the other) such that when the batter inserts each hand into the appropriate glove and then secures or tightens the wristbands, the batter may hold the bat in a natural manner just as if the batter was wearing two separate batting gloves. Accordingly, the invention is not to be restricted except by the claims which follow.

What is claimed is:

1. A device to be worn by a batter for training the batter to keep both of the batter's hands on a bat while swinging or otherwise maneuvering the bat, said device comprising:

a right wristband of non-adjustable length having an inner surface and an outer surface attachable to the right wrist of the batter; and a left wristband of non-adjustable length having an inner surface and an outer surface attachable to the left wrist of the batter; and a knuckle cover for covering one or more knuckles of the batter having a first end and a second end, the first end being affixed at an angle oblique to the right wristband intermediate the ends thereof and the second end being affixed at an angle oblique to the left wristband intermediate the ends thereof, the right wristband and the left wristband being longitudinally offset with respect to each other.

2. The device as in claim 1 further comprising a finger strap connected to the knuckle cover.

3. The device as in claim 1 further comprising primary fastener material attached to the inner surface of the right wristband, and companion fastener material attached to the outer surface of the right wristband.

4. The device as in claim 1 wherein the wristbands and the knuckle cover are elastic.

5. The device as in claim 1 wherein the wristbands are adjustable.

6. The device as in claim 1 wherein the wristbands are closed.

7. A device as in claim 1 wherein the bat is a baseball bat.

8. A device as in claim 1 wherein the bat is a softball bat.

9. A durable and lightweight device for training a batter to keep both of the batter's hands on a piece of sporting equipment while swinging or otherwise maneuvering the bat, said device comprising:

an elastic right wristband attachable to the right wrist of the batter;

an elastic left wristband attachable to the left wrist of the batter; and an elastic knuckle cover for covering one or more knuckles of the batter having a first and a second end, said knuckle cover comprising an elastic band, the first end of the knuckle cover being affixed at an angle oblique to the right wristband intermediate the ends thereof and the second end of the knuckle cover being affixed at an angle oblique to the left wristband intermediate the ends thereof, the right wristband and the left wristband being longitudinally offset with respect to each other.

10. The device as in claim 6 further comprising a finger strap connected to the knuckle cover, and wherein the knuckle cover is affixed to the wristbands by stitching.

11. The device as in claim 6 further comprising an elastic finger strap connected to the knuckle cover.

12. A device to be worn by a batter for training the batter to keep both of the batter's hands on a bat while swinging or otherwise maneuvering the bat, said device comprising:

a right wristband having an inner surface and an outer surface and attached to the right wrist of the batter; and a left wristband having an inner surface and an outer surface and attachable to the left wrist of the batter; and a knuckle cover for covering one or more knuckles of the batter having a first end and a second end, the first end being affixed at an angle oblique to the right wristband intermediate the ends thereof and the second end being affixed at an angle oblique to the left wristband intermediate the ends thereof, the right wristband and the left wristband being longitudinally offset with respect to each other.

13. A method of training an batter to keep both of the batter hands on a piece of sporting equipment while swinging or otherwise maneuvering the piece of equipment, said method comprising the steps of:

providing a training device having a left wristband, a right wristband, and a knuckle cover therebetween connecting the left wristband to the right wristband;

securing the left wristband around the batter left wrist;

securing the right wristband around the batter right wrist;

adjusting the device such that the knuckle cover covers at least a portion of the batter knuckles; and a finger strap connected to the knuckle cover, and the method further comprises the steps of positioning at least two of the batter right fingers under the finger strap, and positioning at least two of the athlete's left fingers under the finger strap.

14. A method of training an athlete to keep both of the batter hands on a piece of sporting equipment while swinging or otherwise maneuvering the piece of equipment, said method comprising the steps of:

providing a training device having a left wristband, a right wristband, and a knuckle cover therebetween connecting the left wristband to the right wristband;

securing the left wristband around the batter left wrist;

securing the right wristband around the batter right wrist;

adjusting the device such that the knuckle cover covers at least a portion of the batter knuckles;

wherein the device further comprises a finger strap connected to the knuckle cover, and the method comprises the steps of positioning one of the batter right fingers under the finger strap, and positioning one of the batter left fingers under the finger strap; and further comprising the steps of the athlete gripping a baseball bat while wearing the training device.

15. A method of training a batter to keep both of the batter's hands on a bat while swinging or otherwise maneuvering the bat, said method comprising the steps of:

providing a training device having a left wristband, a right wristband, and a knuckle cover therebetween connecting the left wristband to the right wristband;

securing the left wristband around the batter's left wrist;

securing the right wristband around the batter's right wrist; and adjusting the device such that the knuckle cover covers at least a portion of the batter's knuckles.

16. The method as in claim 15 further comprising the step of the batter gripping a baseball bat while wearing the training device.

17. The method as in claim 15, wherein the device further comprises a finger strap connected to the knuckle cover, and the method further comprises the steps of positioning one of the batter's right fingers under the finger strap, and positioning one of the batter's left fingers under the finger strap.

18. The method of claim 15 further comprising the step of positioning the training device in a first orientation if the batter is right-handed or a second orientation if the batter is left-handed.

19. A method of training an batter to keep both of the batter hands on a piece of sporting equipment while swinging or otherwise maneuvering the piece of equipment, said method comprising the steps of:

providing a training device having a left wristband, a right wristband, and a knuckle cover therebetween connecting the left wristband to the right wristband;

securing the left wristband around the batter left wrist;

securing the right wristband around the batter right wrist;

adjusting the device such that the knuckle cover covers at least a portion of the batter knuckles; and wherein the training device further comprises a set of primary and companion fastener materials attached to each of the right and left wristbands, and wherein the steps of securing the wristbands around the batter wrists further comprises wrapping the wristbands around the batter wrists such that the primary fastening material on each wristband cooperates with the companion fastening material on the same wristband.

20. The method as in claim 19 further comprising the step of the batter gripping a baseball bat while wearing the training device.

* * * * *